US006223553B1

(12) United States Patent
Albert et al.

(10) Patent No.: US 6,223,553 B1
(45) Date of Patent: May 1, 2001

(54) AIR FLOW FOR REFRIGERATOR FOOD STORAGE SYSTEM

(75) Inventors: Jane Albert, Dahinda; William J. Vestal, II, Monmouth; Richard D. Smith, Jr., Galesburg, all of IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/487,713

(22) Filed: Jan. 19, 2000

Related U.S. Application Data

(63) Continuation-in-part of application No. 09/258,355, filed on Feb. 26, 1999.

(51) Int. Cl.[7] ..... F25D 17/04
(52) U.S. Cl. ..... 62/407; 62/412; 62/441
(58) Field of Search ..... 62/407, 404, 411, 62/412, 187, 441, 443, 451

(56) References Cited

U.S. PATENT DOCUMENTS

| | | | |
|---|---|---|---|
| 1,693,387 | 11/1928 | Juneau et al. . | |
| 1,774,312 | 8/1930 | Braeutigam . | |
| 2,246,342 | 6/1941 | Brown . | |
| 2,404,851 | 7/1946 | Knowles et al. . | |
| 3,364,694 | 1/1968 | Cohen et al. . | |
| 3,600,905 | 8/1971 | Dymek et al. . | |
| 3,609,988 | 10/1971 | Bright . | |
| 3,638,717 | 2/1972 | Harbour et al. . | |
| 3,680,941 | 8/1972 | Shanks . | |
| 4,173,378 | 11/1979 | Hanson et al. . | |
| 4,662,186 | 5/1987 | Park . | |
| 4,722,200 | 2/1988 | Frohbieter . | |
| 4,732,014 | 3/1988 | Frohbieter . | |
| 4,751,826 | 6/1988 | Kawahara et al. . | |
| 4,788,832 | 12/1988 | Aoki et al. . | |
| 4,920,758 | 5/1990 | Janke et al. . | |
| 4,924,680 | 5/1990 | Janke et al. . | |
| 5,095,717 | 3/1992 | Germi . | |
| 5,392,615 | 2/1995 | Lim . | |
| 5,490,395 * | 2/1996 | Williams et al. | 62/187 |
| 5,694,788 * | 12/1997 | Shin | 62/407 |
| 5,778,694 | 7/1998 | Jeong . | |
| 5,918,480 | 7/1999 | Nagata et al. . | |
| 5,960,641 * | 10/1999 | Kim et al. | 62/407 |

FOREIGN PATENT DOCUMENTS 719 994 7/1996 (EP) .

* cited by examiner

*Primary Examiner*—Corrine McDermott
*Assistant Examiner*—Chen-Wen Jiang
(74) *Attorney, Agent, or Firm*—Everett G. Diederiks, Jr.

(57) ABSTRACT

A food storage system mounted in a fresh food compartment of a refrigerator includes an enclosure defined by inner and outer housings, as well as a food receptacle slidably positioned in the inner housing. The inner and outer housings are spaced so as to define a zone therebetween within which air is forced to flow in order to cool the contents of the receptacle. A tunnel insert is positioned in a mullion zone defined between fresh food and freezer liners of the refrigerator, with the tunnel insert being formed with a through hole for directing the flow of cooling air into the food storage system, a channel for directing an exhaust flow of cooling air from the food storage system out of the fresh food compartment within the mullion zone and an enlarged opening defining a return air passage for the overall fresh food compartment. The tunnel insert, within the mullion zone, channels the exhaust air from the food storage system to the return air passage. The channel is preferably defined by four walls, three of which are created by a groove formed in the tunnel insert and the fourth wall being defined by a portion of the fresh food compartment liner which seats against the tunnel insert. An air inlet cover is provided to extend over supply air openings formed in a freezer liner of the refrigerator, with the inlet cover including forwardly angled louvers to assist in directing a flow of cooling air to the food storage system.

24 Claims, 9 Drawing Sheets

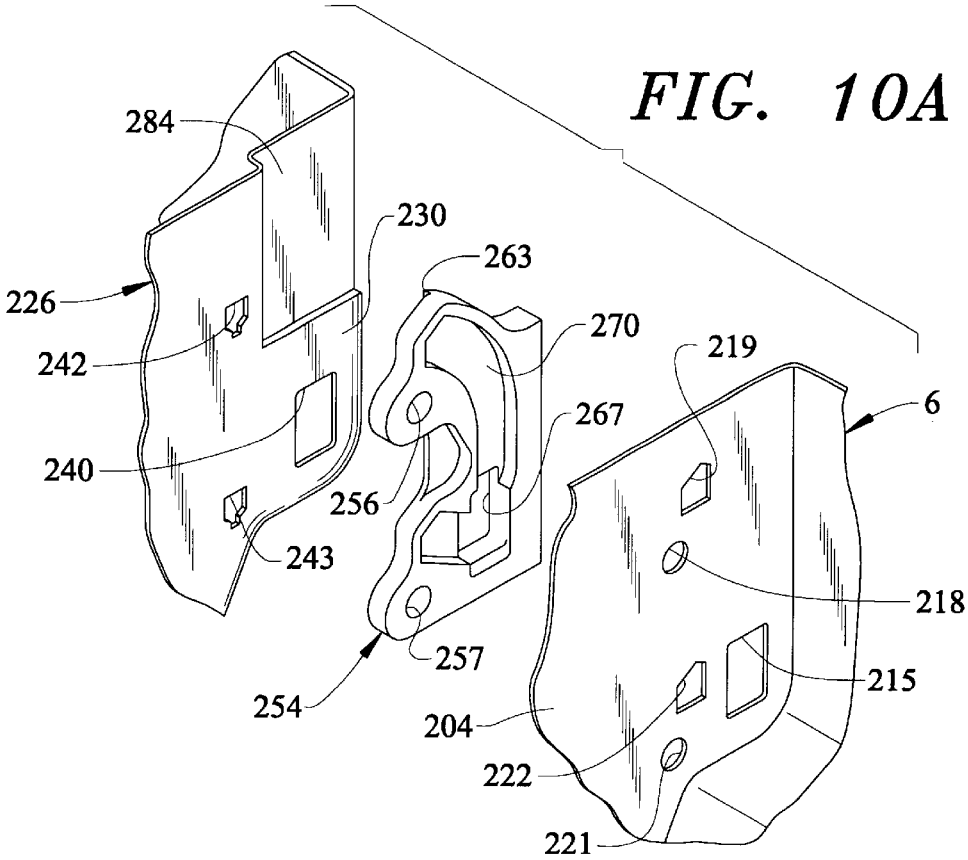
FIG. 10A
FIG. 10B
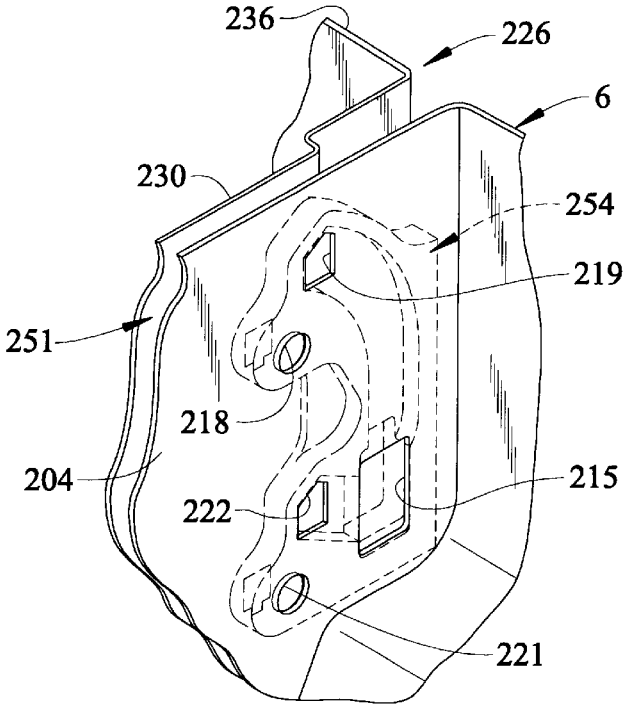

AIR FLOW FOR REFRIGERATOR FOOD STORAGE SYSTEM

This application represents a continuation-in-part of pending U.S. patent application Ser. No. 09/258,355 filed Feb. 26, 1999.

BACKGROUND OF THE INVENTION

1. Field of the Invention

The present invention pertains to the art of refrigerators and, more particularly, to an air flow arrangement for a refrigerator assembly used to store food items in a controlled humidity and temperature environment.

2. Discussion of the Prior Art

In the art of refrigerators, particularly household refrigerators, it is often desirable to create varying humidity and/or temperature storage zones to enhance the preservation of different food items. For instance, it is common to accommodate the storage requirements for certain food items, such as dairy products, meats, fruits and vegetables, by forming separately enclosed storage areas within a fresh food compartment. In most instances, these storage areas are designed to be maintained at temperatures which are different from the temperature of the remainder of the fresh food compartment.

In at least the case of fruits and vegetables, it is typically desirable to isolate these food items from direct contact with a flow of cooling air, especially any cold air flowing into the fresh food compartment from a freezer compartment of the refrigerator, mainly because this cold air can be fairly dry. Therefore, in order to isolate the fruits and vegetables from the desiccating effects of the cold air so as to maintain the moisture content of the fruits and vegetables, it has heretofore been proposed to provide a specialized storage receptacle, such as a crisper, within a refrigerator fresh food compartment. A crisper generally takes the form of a slidable bin which is sealed to maintain a relatively high humidity level, while the walls of the bin are chilled to establish a desirable temperature within the bin.

Many different food storage compartment designs have been proposed in the art in an attempt to establish and maintain effective humidity and temperature conditions within the compartment while attempting to avoid the development of condensation. However, there still exists a need for an improved storage compartment system which can maintain a desired humidity level, accurately control the temperature and minimize the tendency for condensation within the compartment. In designing a specialty food storage compartment for a refrigerator, consideration must be taken of the manner in which a flow of cooling air is effectively and efficiently supplied to and exhausted from the food, vegetable, meat or the like bin.

SUMMARY OF THE INVENTION

The present invention is directed to an air flow system for a high performance refrigerator storage compartment which is constructed to prevent the loss of humidity, provide an accurately controlled temperature environment and minimize the potential for condensation within a food storage receptacle. The high performance refrigerator storage compartment includes an enclosure, which is mounted within a fresh food compartment of a refrigerator, and a food receptacle, preferably in the form of a bin or drawer, which is slidably mounted between a retracted position, wherein a food storage body portion of the receptacle is generally sealed within the enclosure, and an extended position, wherein the food receptacle is at least partially withdrawn from the enclosure to access the storage body.

In the most preferred form, the enclosure has an open frontal portion and is defined by inner and outer housings. More specifically, the inner housing is concentrically positioned within and internally spaced from the outer housing. Numerous vanes extend between the inner and outer housings and define flow passages or channels over, around and beneath the inner housing. A rear portion of the enclosure is subdivided by a partition wall into upper and lower plenum chambers. A fan is disposed in the partition wall to generate a flow of cooling air into the upper plenum chamber which is guided by the vanes to flow within the passages across a top wall of the inner housing, down along side walls thereof, along the bottom wall of the inner housing and to the lower plenum chamber. In this manner, the cooling air extends around the entire inner housing to establish a uniform, accurate temperature for the food storage receptacle.

Although the preferred form of the invention recirculates a majority of the air flow in order to ensure a minimal temperature gradient through the recirculated air stream, the outer housing is formed with an intake opening which fluidly communicates the freezer compartment of the refrigerator with the interior of the enclosure, while an exhaust opening also leads from the enclosure. At least one temperature sensor is preferably provided to sense the temperature in the enclosure for use in controlling the flow of cold air from the freezer compartment, in combination with controls provided at the front of the bin.

The system also preferably incorporates a variable moisture permeable film, such as a shape memory polymer, which extends across a portion of the inner housing. The presence of the film aids in assuring optimum humidity, minimum condensation and accurate temperature control within the bin in order to improve the useful life of the food items stored therein. The film has associated characteristics enabling the humidity permeability to increase with increasing temperatures. When the temperature in the bin is low, the film functions to prevent the escape of water vapors from within the bin. However, when the temperature increases, excess water vapor will be permitted to escape, thus greatly reducing the possibility of dew condensation.

The present invention is particularly concerned with the manner in which cooling air is supplied to and exhausted from the high performance storage compartment. In accordance with the invention, the fresh food compartment of the refrigerator has a main cooling air supply inlet and a main return air outlet. An air tunnel insert is positioned in a mullion zone between fresh food and freezer compartment liners of the refrigerator. The insert includes an enlarged opening which aligns with the return air outlet such that the insert aids in defining the return air passage. In addition, the insert includes a cooling air supply through hole which is aligned with an additional opening in the fresh food and freezer liners and which functions to define a passage for directing a supply of cooling air from the freezer compartment directly to the enclosure of the high performance storage system within the fresh food compartment. Exhaust air from the enclosure is directed through another opening in the fresh food liner and into a channel defined by the insert. The channel directs this exhaust air, within the mullion zone, to mix with the main return air from the remainder of the fresh food compartment at the return air passage.

In accordance with the most preferred embodiment of the invention, upper and lower high performance food storage compartments are provided and a single air tunnel insert is formed with separate air supply passages and separate channels for respective exhaust air flows. Further in accordance with the most preferred form of the invention, each of the channels is defined by four walls, three of which are defined by the insert itself, and the fourth being defined by a portion of the fresh food liner against which the insert is seated. Therefore, the insert is formed with grooves leading to the main return air passage and these grooves are covered by the fresh food liner in order to define the channels. The use of the air tunnel insert provides for the dedicated air supply passages and effectively combines the return air flows from both specialty compartments and the overall fresh food compartment, while assuring that the air returns to the evaporator coil area near the defrost heater for the refrigerator.

Additional objects, features and advantages of the invention will become readily apparent from the following detailed description of a preferred embodiment of the invention when taken in conjunction with the drawings wherein like reference numerals refer to corresponding parts in the several views.

BRIEF DESCRIPTION OF THE DRAWINGS

FIG. 10A is an exploded view illustrating the position of the air tunnel insert between the fresh food and freezer liners;

FIG. 10B is an assembled view of the air tunnel insert and refrigerator liners;

DETAILED DESCRIPTION OF THE PREFERRED EMBODIMENTS

Figure 1:
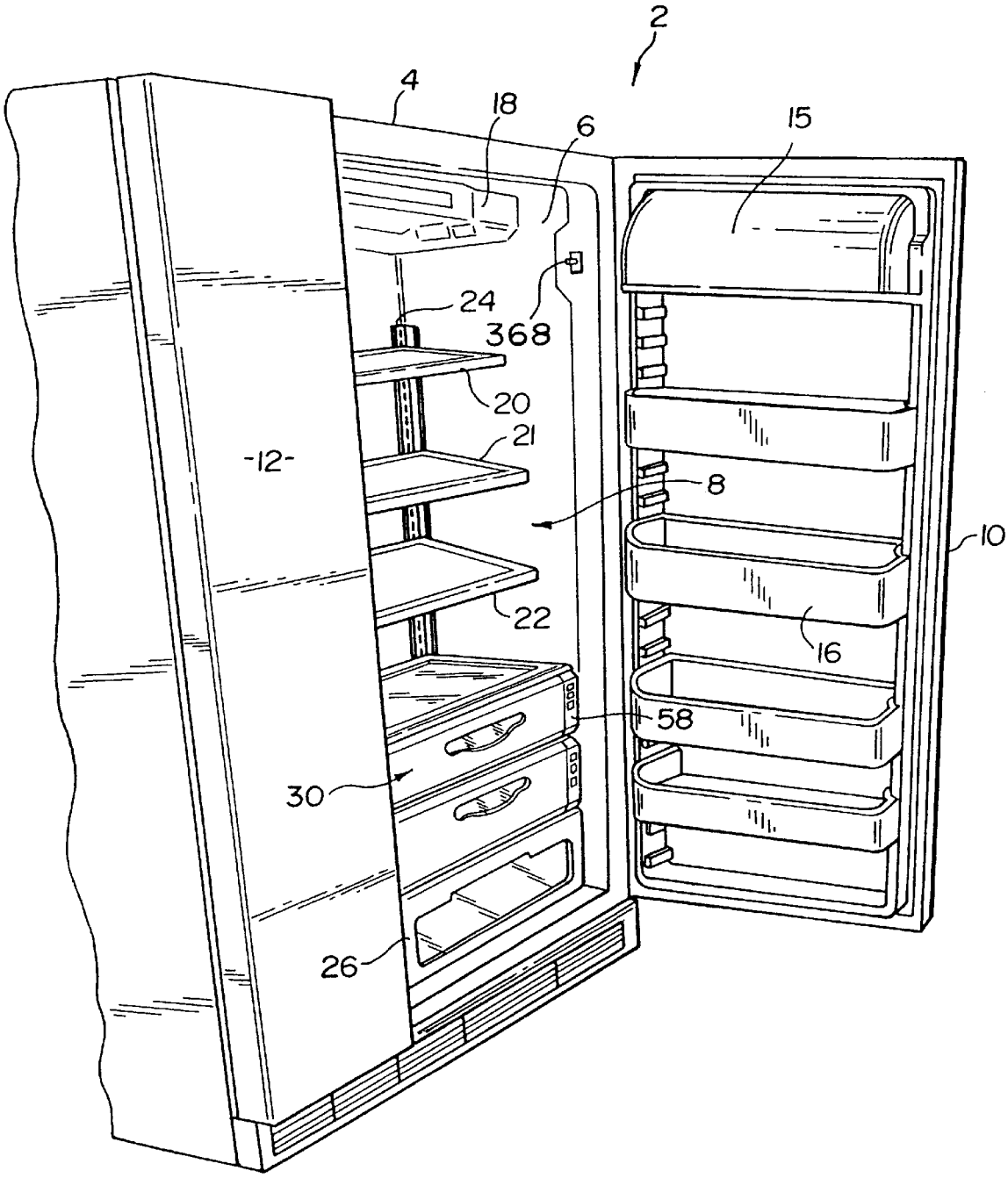
FIG. 1 is a partial, front perspective view of a side-by-side refrigerator incorporating the high performance food storage system of the present invention in the fresh food compartment thereof.

With initial reference to FIG. 1, a refrigerator cabinet 2 includes a shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a liner defined freezer compartment (not shown in FIG. 1). For the sake of completeness, refrigerator cabinet 2 is shown to include, on door 10, a dairy compartment 15 and various vertically adjustable shelving units, one of which is indicated at 16. Mounted in an upper area of fresh food compartment 8 is a temperature control housing 18 which, in a manner known in the art, can be used to regulate the temperature in both fresh food compartment 8 and the freezer compartment. Further illustrated, for exemplary purposes, is a plurality of shelves 20–22 which are cantilevered from spaced rails, one of which is indicated at 24. At a lowermost portion of fresh food compartment 8 is illustrated a slidable bin 26. As indicated above, the above described structure is known in the art and presented only for the sake of completeness. The present invention is particularly directed to a food storage compartment system which is generally indicated at 30. Although FIG. 1 actually illustrates two such compartment systems 30, it should be realized that the actual number of compartment systems 30 can be readily varied.

Reference will now be made to FIGS. 2–5 in describing a first preferred embodiment of the system 30 of the present invention. As illustrated, system 30 includes an enclosure 35 having an outer housing 37, formed from a lower section 39 and an upper section 40, and an inner housing 43. Given that the embodiment shown in FIGS. 2–5 corresponds to the upper system 30 shown in FIG. 1, upper section 40 of enclosure 35 is preferably defined by a glass plate 45 that is encapsulated in a plastic rim 46 such that the upper section 40 of the enclosure 35 has an upper exposed surface generally similar to each of cantilevered shelves 20–22. It should also be realized, however, that upper section 40 could simply be constituted by a unitary plate, such as one formed of plastic.

In the most preferred form, lower section 39 of outer housing 37 includes a bottom wall 48, an upstanding rear wall 49, upstanding side walls 51 and 52 and an open frontal portion indicated at 54. In the preferred embodiment, the entire lower section 39 of outer housing 37 is integrally molded of plastic, with a wall 56 projecting laterally from side wall 52 as perhaps best shown in FIG. 3. Wall 56 establishes a mounting section 57 within which a control module 58 (see FIG. 1) is arranged.

Referring back to FIGS. 2–5, the bottom wall 48 of lower section 39 of outer housing 37 has a first, frontal section 60 which leads to a raised second, rear section 61. Bottom wall 48 is preferably formed with a plurality of vanes, including a central vane 63 and various spaced, curved vanes 64–67. Rear section 61 of outer housing 37 also has associated therewith a partition plate 69 having a central aperture through which projects an impeller portion of a fan 71. Fan 71 includes an electric motor 72 which is secured to partition plate 69 by means of a bracket 73. The actual positioning and mounting of partition plate 69 will be discussed more fully below. However, at this point, it should be realized that partition plate 69 is adapted to be mounted within rear section 61 between spaced openings 76 and 77. In this embodiment, opening 76 constitutes an air inlet and opening 77 defines an air outlet such that the zone above partition plate 69 defines an upper plenum chamber 79 and the zone below partition plate 69 defines a lower plenum chamber 80. Again, this structure will be more fully brought out when describing the remaining structure associated with storage compartment system 30.

As indicated above, system 30 also includes an inner housing 43 that is preferably molded of plastic to include a top wall 84, a bottom wall 85, side walls 86 and 87, a rear wall 88 and an open frontal portion 89. In the preferred form of the invention, open frontal portion 89 is formed with an annular, outwardly extending flange 90. As clearly shown in these figures, top wall 84 of inner housing 43 is formed with a central vane 93, as well as various spaced and curved vanes 94–97, each of which extends from adjacent rear wall 88 a predetermined distance towards annular flange 90 in a manner essentially parallel to central vane 93. Thereafter, each vane 94–97 includes an arcuate section which leads the vane towards a respective side wall 86, 87. Each of the vanes 94–97 then extends downwardly along a respective side wall 86, 87. Furthermore, in the most preferred form of the invention, rear wall 88 includes lateral extensions 99 and 100 which also define vanes at a rear edge portion of side walls 86 and 87 respectively.

Inner housing 43 is adapted to be positioned within outer housing 37 in a manner which aligns the lower terminal ends of vanes 94–97 at side walls 86 and 87 with curved side vanes 64–67. With the alignment of these vanes, enclosure 35 defines various channels or passages between respective sets of the vanes. For example, vanes 93 and 96 establish an air flow passage 101, in conjunction with upper section 40, which extends from upper plenum chamber 79 toward annular flange 90, then downward along side wall 87, between bottom wall 85 of inner housing 43 and bottom wall 48 of outer housing 37. Between these bottom walls, passage 101 continues due to the arrangement of central vane 63 and curved vane 66 into lower plenum chamber 80. Given the arrangement of the numerous vanes and the formation of the various passages, a flow of air developed by fan 71 will be assured to extend across essentially the entire outer surface area of inner housing 43.

At this point, it is important to note that outer housing 37 has a greater depth than inner housing 43. This is perhaps best illustrated in FIGS. 4 and 5. It is based on this difference in depth that partition plate 69 can be arranged to define the upper and lower plenum chambers 79 and 80. More specifically, in the preferred embodiment, rear wall 88 of inner housing 43 is preferably formed with a pair of horizontally extending projections 106 and 107 and rear wall 49 of outer housing 37 is integrally formed with a ledge 109. Partition plate 69 has one lateral edge arranged between projections 106 and 107 and a second, laterally extending edge which is seated upon ledge 109 such that fan 71 is advantageously angled upwardly and forwardly.

With this arrangement, air within enclosure 35 will be forced to flow upwardly out of upper plenum chamber 79 across substantially the entire top wall 84 of inner housing 43, down between side walls 86, 87 and side walls 51 and 52, within the passages defined between bottom wall 48 and bottom wall 85 and to return into lower plenum chamber 80. In accordance with the preferred embodiment of the invention, a majority of the air returning to lower plenum chamber 80 is recirculated. However, inlet 76 is placed in fluid communication with air flowing within the freezer compartment of refrigerator cabinet 2 through the vertical dividing wall or mullion (described more fully below) which conventionally separates the refrigerator compartments. Supplying cold air from a freezer compartment to a specialty compartment zone is fairly conventional in the art. In accordance with the preferred embodiment, a damper (not shown) is preferably provided to control the amount of cold air flowing into inlet 76, with the damper being regulated through the manual setting of control module 58. Although further details of the damper arrangement will be provided below, at this point it should be noted that a temperature sensor 116 is shown provided within lower plenum chamber 80 (see FIG. 5) and a second temperature sensor 117 (see FIG. 6) extends within inner housing 43 through an opening 118. Temperature sensor 116 is connected to control module 58 for use in regulating the damper that controls the amount of intake air permitted to flow through inlet 76, while temperature sensor 117 is used to sense an actual temperature in inner housing 43. Although two temperature sensors 116 and 117 have been shown, the most preferred embodiment only utilizes temperature sensor 117 which can function to also control the damper as will be detailed fully below.

Figure 3:
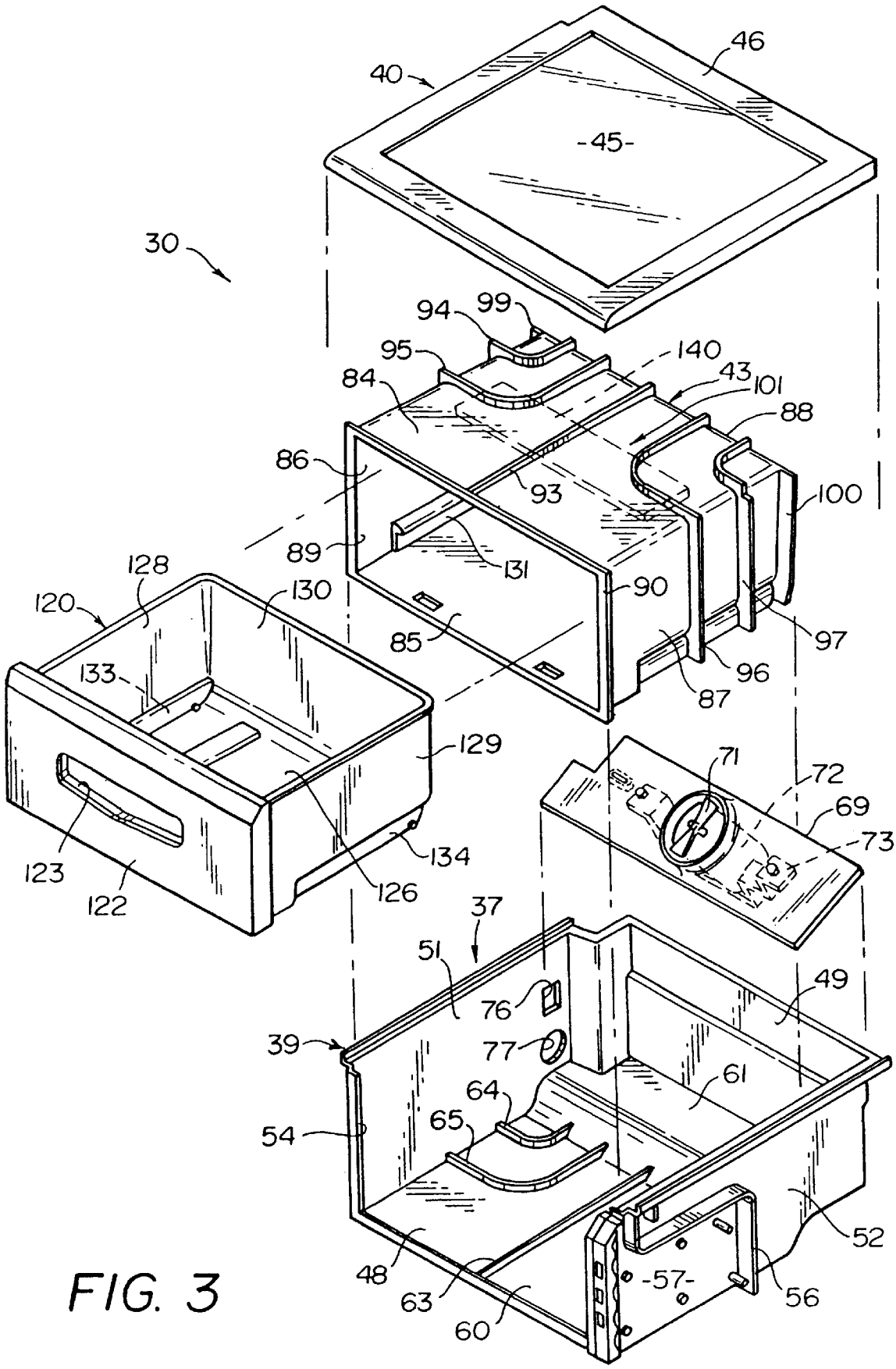
FIG. 3 is an exploded view of the system constructed in accordance with a first embodiment of the invention.
Figure 4:
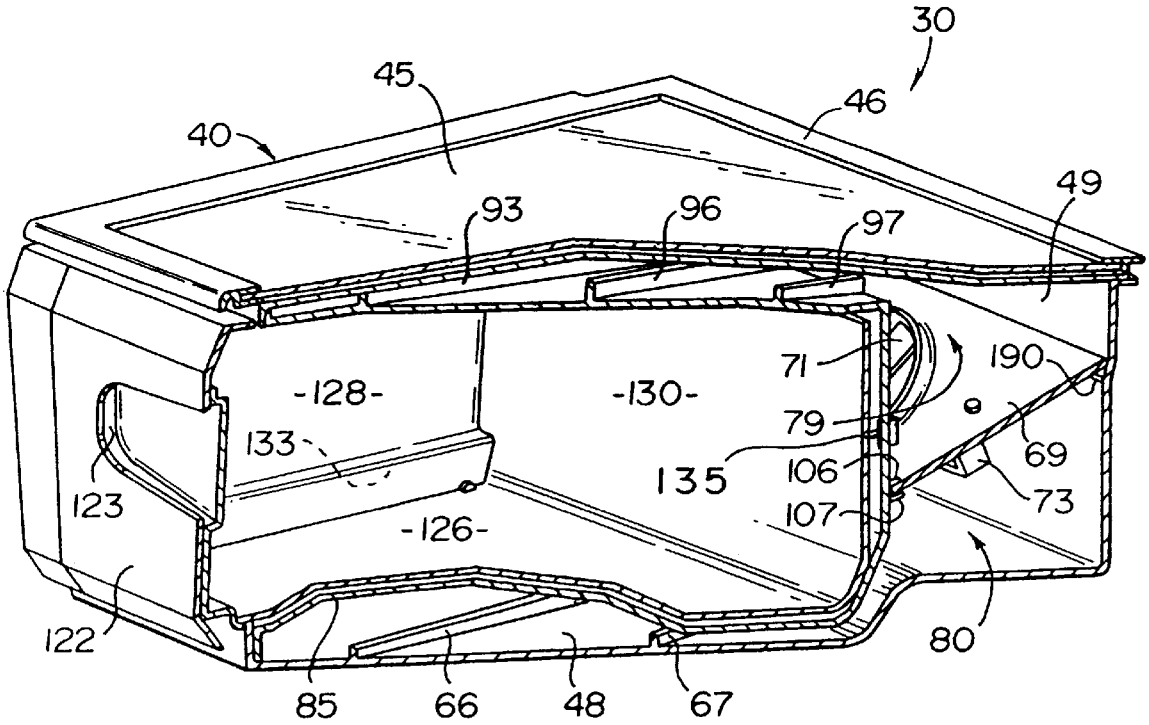
FIG. 4 is a perspective view of the system of FIG. 3 with a cutaway portion.
Figure 5:
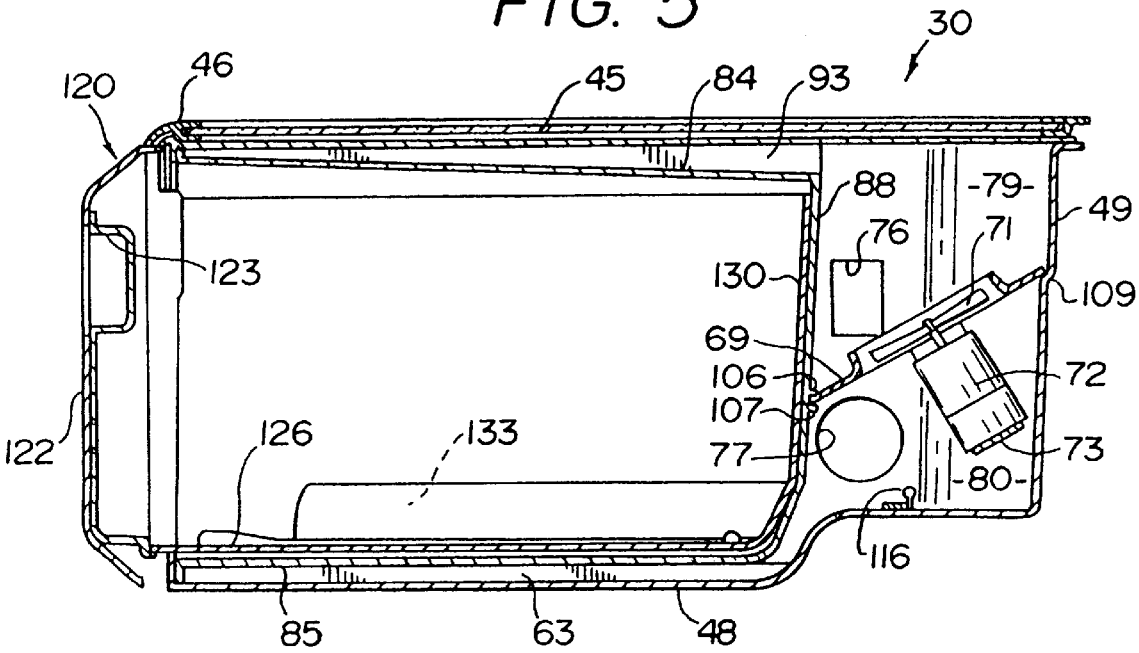
FIG. 5 is a cross-sectional side view of the system of FIGS. 3 and 4.

System 30 also includes a receptacle 120 that takes the form of a drawer or bin having a front wall 122 provided with a handle 123, a floor 126, side walls 128 and 129 and a rear wall 130. In the preferred embodiment shown, floor 126, side walls 128 and 129 and rear wall 130 are integrally molded of plastic and a plastic front wall 122 is secured thereto, such as through sonic welding. Receptacle 120 is adapted to be slidably mounted within inner housing 43 between a retracted position, as best shown in FIGS. 4 and 5, and an extended position wherein a storage area defined by receptacle 120 can be accessed for the placement and removal of food items, such as fruits, vegetables and meats. For slidably supporting receptacle 120, inner housing 43 is preferably provided with a pair of horizontally extending rails, one of which is shown in FIG. 3 at 131, which extend within elongated recesses 133 and 134 defined at the lowermost section of side walls 128 and 129. Of course, other types of guiding support arrangements could be readily provided without departing from the spirit of the invention. Furthermore, to signal the closure of receptacle 120, a switch 135 is adapted to be engaged as shown in FIG. 4.

When fully closed, the front wall 122 of receptacle 120 tightly abuts enclosure 35 such that system 30 essentially provides a tightly sealed receptacle 120 so as to prevent the undesirable loss of humidity. Since a cooling air flow extends essentially around the entire outer surface of inner housing 43, each of the side walls 128 and 129 and rear wall 130 of receptacle 120 are indirectly cooled, as well as the interior of the receptacle 120. This uniform cooling arrangement, in combination with the inclusion and operation of fan 71 and the controlled introduction and exhaust of air into and out of enclosure 35, enables an accurate temperature control environment to be established for the system 30, while minimizing any tendency for condensation within receptacle 120. Again, the preferable flow of air developed by fan 71 is upward from behind receptacle 120, passes over the top of the receptacle 120 and, through the use of vanes 63–67 and 93–97, is channeled adjacent to the sides and then across the bottom until it returns to lower plenum chamber 80. Therefore, the flow path causes the air to effectively contact all of the containment surfaces of receptacle 120 in order to provide a good transfer of heat.

Although the preferred embodiment incorporates temperature sensor 117 to regulate the amount of cold air drawn into upper plenum chamber 79 from the freezer compartment as established by the manually set controls, it should be noted that cold air from the freezer compartment could be drawn into the enclosure by virtue of the relative static pressure between the freezer compartment and the low pressure plenum chamber 80 of enclosure 35. As indicated above, this flow could also be controlled by an electromechanical damper regulated by the electronic control module 58. In any event, as cold air is injected from the freezer compartment into inlet 76, a corresponding amount of air is ejected from enclosure 35 through outlet 77. Typically, the ratio of circulated air to injected air would be quite high in order to ensure minimal temperature gradient throughout the circulated air stream, with the purpose being to cool the contents of the receptacle 120 with a minimum overall temperature difference between the air in the receptacle 120 and the cooling air stream flowing between the inner and outer housings 43 and 37.

In accordance with another aspect of the invention, system 30 preferably incorporates a variable moisture permeable film, such as a currently available shape memory polymer. The potential incorporation of this film is illustrated at 140 by the dotted lines shown in FIG. 2 as incorporated in top wall 84 of inner housing 43. The function of such a variable moisture permeable film is to maintain the optimum humidity, minimize condensation and further enhance the ability of storage compartment system 30 to establish an optimum temperature so as to improve the shelf life of produce or the like stored in receptacle 120. More specifically, shape memory polymers are known to perform humidity control functions as the material inherently increases in moisture permeability with increasing temperature. Therefore, when the temperature remains low in receptacle 120, water vapor is kept from escaping. However, when the temperature increases, the excess water vapor can escape. This reduces the possibility of dew condensation in receptacle 120. Such a shape memory polymer, as currently available in the marketplace, has a glass transition temperature around which its moisture permeability rapidly changes. The moisture permeability range, glass transition temperature, location and an amount of surface area exposed directly to the food items placed within receptacle 120 can be readily optimized to reduce condensation in retaining the optimum humidity level. Although the speed of operation of fan 71 could be regulated through control module 58 to enhance the rate at which the conditioned air flows within enclosure 35 to control the moisture transfer rate through the shape memory polymer material, in the most preferred form of the invention, fan 71 is simply controlled to be either on or off. In any case, when such a known moisture permeable film is included in system 30, fan 71 will aid in regulating the moisture transfer rate through the material to further aid in establishing the optimum humidity in the receptacle 120.

Figure 6:
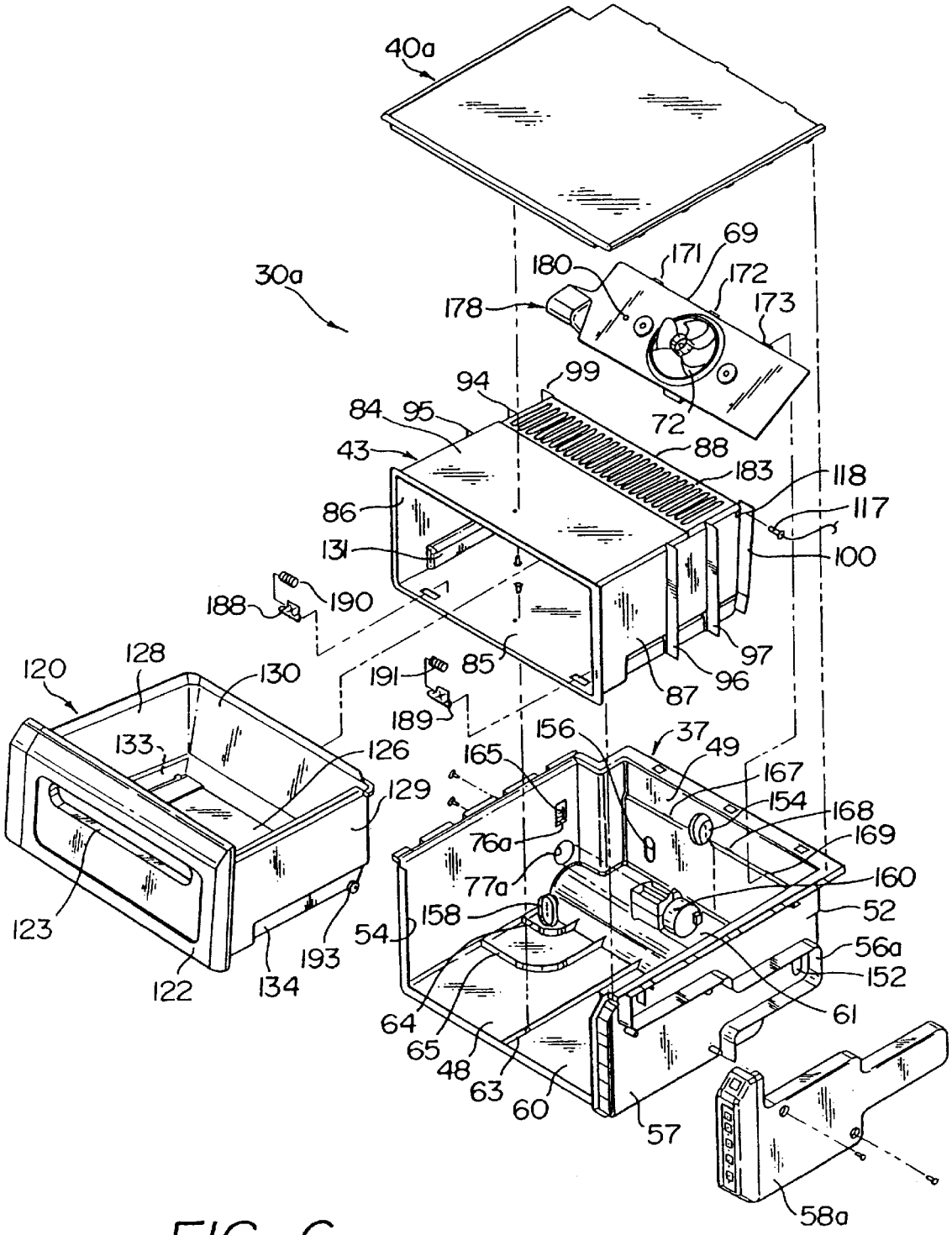
FIG. 6 is an exploded view similar to that of FIG. 3 but depicting a system constructed in accordance with a second embodiment of the invention.

Reference will now be made to FIG. 6 in describing another preferred embodiment for the food storage system of the present invention. In general, the system 30*a* of this embodiment is constructed and operates in a manner corresponding to that described above with respect to the first embodiment of the invention. However, this embodiment brings out further potential design modifications within the scope of the overall invention. Since a majority of the structure of this embodiment directly corresponds to that described above, like reference numerals will refer to corresponding parts in the several views and the differences between the embodiments will be brought out below, with these differences being generally apparent from comparing FIGS. 3 and 6 of the present application.

First of all, in accordance with the embodiment of FIG. 6, it should be noted that outer housing 37 is provided with a slightly differently configured wall 56*a* to accommodate control module 58*a*. At a rear portion of upstanding side wall 52 of outer housing 37, there is shown an opening 152 which is provided for the routing of wires to control module 58*a*. A corresponding type of opening would also be provided in the first embodiment described above but has not been shown to simplify the drawings. In any event, as depicted in FIG. 6, opening 152 receives a plug 154 through which the wires would extend. A similar opening 156 is depicted for upstanding rear wall 49 which also receives a plug 158 that can accommodate the passage of wires therethrough.

One major distinction between the embodiment shown in FIGS. 2–5 and that illustrated in FIG. 6 is that opening 76*a* and this embodiment represents an air outlet for the storage compartment system and opening 77*a* represents the inlet. Mounted at air inlet 77*a* is a damper 160 that is electrically linked to control module 58*a* by suitable wiring (not shown). In accordance with this embodiment, air outlet 76*a* is also provided with a flap valve indicated at 165. Another difference in the construction of outer housing 37 of this embodiment is the inclusion of various laterally spaced slots 167–169 that are provided in upstanding rear wall 49 for the mounting of partition plate 69. Correspondingly, partition plate 69 is provided with various laterally spaced tabs 171–173 such that, unlike the first embodiment where the partition plate 69 rests against ledge 109, the tabs 171–173 are received within respective slots 167–169 for the securing of partition plate 69.

In addition, it will be noted that partition plate 69 of this embodiment is formed with a deflector 178 which is shaped to conform to a portion of damper 160 when the system 30*a* is assembled but which is maintained spaced from rear wall 88 of inner housing 43 a slight distance which enables warmer air to bleed adjacent to air inlet 77*a*. Therefore, deflector 178 allows some mixing of warmer air with the coldest air delivered into outer housing 37 through air inlet 77*a*. Furthermore, partition 69 is provided with an aperture 180 through which is adapted to project a temperature sensor (not shown) which replaces temperature sensor 116 in that it signals control module 58*a* for regulating the opening and closing of damper 160. Again, preferably only temperature sensor 117 is actually provided.

With this arrangement, the amount of inlet air drawn into lower plenum chamber 80 through opening 77*a* is controlled by the opening and closing of damper 160. Fan 72 operates in the manner described above in that it functions to direct air over the top wall 84, along side walls 86 and 87 and along bottom wall 85 of inner housing 43. Depending upon the pressure differential created, flap valve 165 can permit a percentage of the air flow to be exhausted from within the enclosure 35. This embodiment also illustrates that it is possible to remove vanes 94–97 from the top wall 84 of inner housing 43. In this embodiment, the corresponding portions of the vanes are provided beneath upper section 40*a* to perform the identical air directing function. The embodiment of FIG. 6 also illustrates the inclusion of a grill 183 as part of top wall 84. Grill 183 can be integrally formed with inner housing 43 or formed as a separate piece and attached thereto. In either case, grill 183 is adapted to have secured thereto a corresponding, variable moisture permeable film (not shown) by any means known in the art, including sonic welding or through the use of an adhesive. Although not specifically described above with respect to the first embodiment of the invention, a similar grill or opening arrangement will also be associated with film 140.

Finally, this embodiment illustrates additional structural details that are preferably incorporated in the embodiment of FIG. 1 as well, such as the use of snap-in roller supports 188 and 189 that receive rollers 190 and 191, as well as the inclusion of rollers 193 on either side of receptacle 120. In any case, with the above construction of the storage compartment system in accordance with either of the embodiments described, an effective heat transfer with receptacle 120 is assured, given that the temperature of the circulated air is regulated and efficiently channeled substantially entirely about the receptacle. The moisture permeable film can further enhance the ability of the system to maintain a desired humidity and temperature environment. Furthermore, since the storage compartment system is essentially self-contained, it can be pre-assembled and advantageously mounted as a unit within refrigerator cabinet 2.

Figure 7:
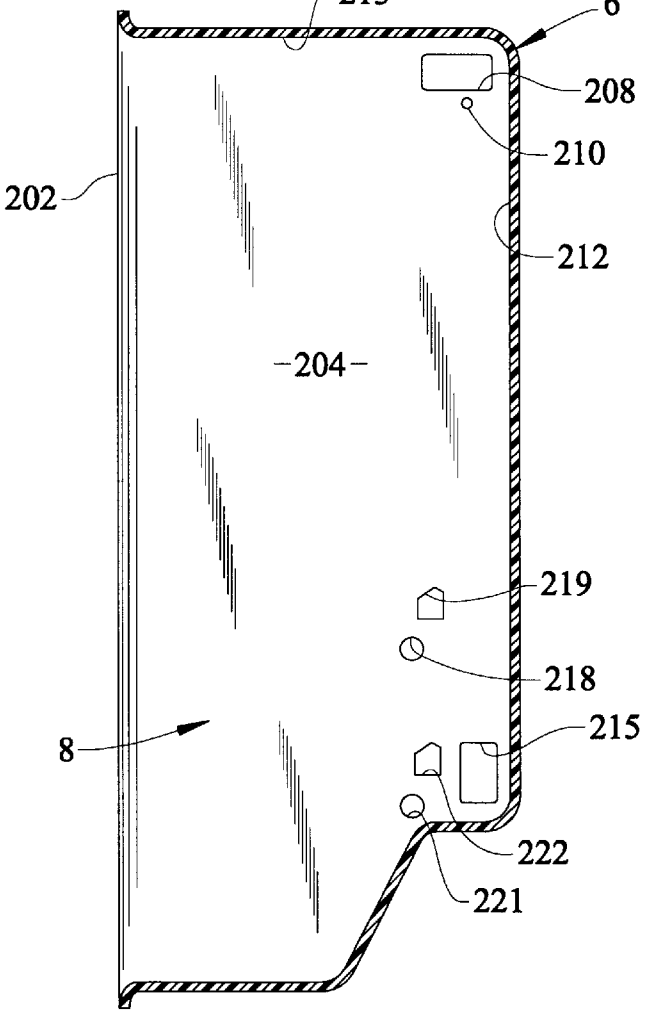
FIG. 7 is a cross-sectional side view of a fresh food liner incorporated in the side-by-side refrigerator of FIG. 1.

The present invention is particularly directed to the overall manner in which cooling air is supplied from the freezer compartment to fresh food compartment 8 and enclosures 35 of the food storage compartment systems 30 and 30*a*, as well as the manner in which return air is exhausted from the fresh food compartment 8 and food storage compartment systems 30 and 30*a*. More specifically, FIG. 7 shows fresh food liner 6 and, particularly, an open frontal portion 202 and a side wall 204. Formed in side wall 204, at an upper rear portion thereof, is a main air inlet opening 208. In a manner known in the art, air inlet opening 208 is essentially covered by temperature control housing 18 which would incorporate a damper (not shown) for regulating the air flow into fresh food compartment 8. For the sake of completeness, an aperture 210 is shown below air inlet opening 208. Aperture 210 is adapted to receive a sensor for signaling the temperature of the cooling air entering fresh food compartment 8. Since this structure is not considered part of the present invention, it will not be further discussed herein. Again, air inlet opening 208 is shown at an upper rear portion of fresh food liner 6 such that it is substantially directly adjacent a rear wall 212 and a top wall 213. Also formed adjacent rear wall 212, at a lower portion of fresh food liner 6, is a main air return opening 215. At this point, it should be realized that providing air inlet opening 208 and air return opening 215 is substantially conventional in the art in order to enable a flow of cooling air to enter fresh food compartment 8 at air inlet opening 208, to be circulated therethrough, and then to exit fresh food compartment 8 through air return opening 215.

Also shown in FIG. 7, side wall 204 of fresh food liner 6 is formed with an upper, preferably circular inlet air opening 218, as well as an upper outlet or exhaust opening 219. Furthermore, a lower air inlet opening 221 and a lower air outlet or exhaust opening 222 are illustrated. In general, each set of openings 218, 219 and 221, 222 are provided for a respective food storage compartment system 30, 30*a*. Since two such vertically arranged systems are provided in accordance with the most preferred embodiment of the invention as illustrated in FIG. 1, side wall 204 of fresh food liner 6 is provided with two sets of inlet and outlet openings 218, 219 and 221, 222.

Figure 8:
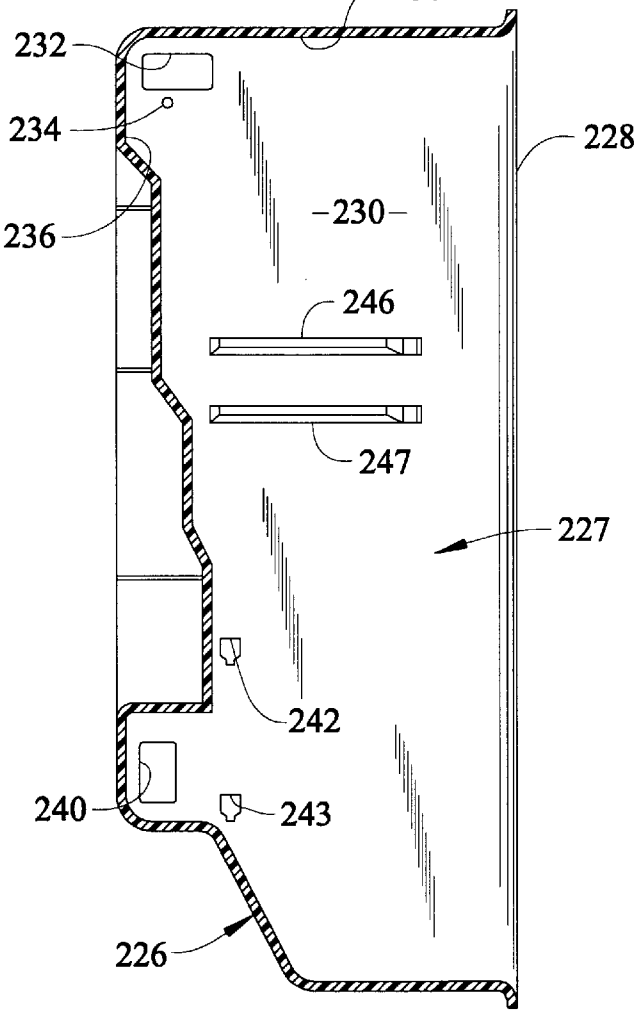
FIG. 8 is a cross-sectional side view of a freezer liner incorporated in the side-by-side refrigerator of FIG. 1.

FIG. 8 sectionally illustrates a freezer liner 226 incorporated into refrigerator cabinet 2. Freezer liner 226 defines a freezer compartment 227 and, in a manner similar to fresh food liner 6, includes an open frontal portion 228 and a side wall 230. Freezer liner 226 has formed therein, in alignment with main air inlet 208, a main air supply opening 232. Adjacent main air supply opening 232 is formed an aperture 234 that is aligned with aperture 210 upon the complete assembly of refrigerator cabinet 2. For alignment with air inlet opening 208, air supply opening 232 is located in side wall 230 adjacent rear wall 236 and top wall 237 of freezer liner 226. Also formed adjacent rear wall 236, at a lower portion of freezer liner 226, is an air return opening 240 that is aligned with main air return opening 215 formed in fresh food liner 6. Also formed in side wall 230 of freezer liner 226 are upper and lower air supply openings 242 and 243 which, upon assembly of refrigerator cabinet 2, become generally aligned with upper and lower inlet openings 218 and 221 respectively. In the most preferred embodiment shown, upper and lower air supply openings 242 and 243 are somewhat funnel-shaped. The reason for this desired construction for openings 242 and 243 will become more fully apparent below. For the sake of completeness, side wall 230 is shown to include a few integrally molded rails 246 and 247 for supporting slidable bins or the like within freezer compartment 227. For the sake of clarity, only the two rails 246 and 247 have been shown, although additional vertically spaced rails would actually be provided to accommodate multiple bins, at least in the lower portion of freezer compartment 227.

Figure 9B:
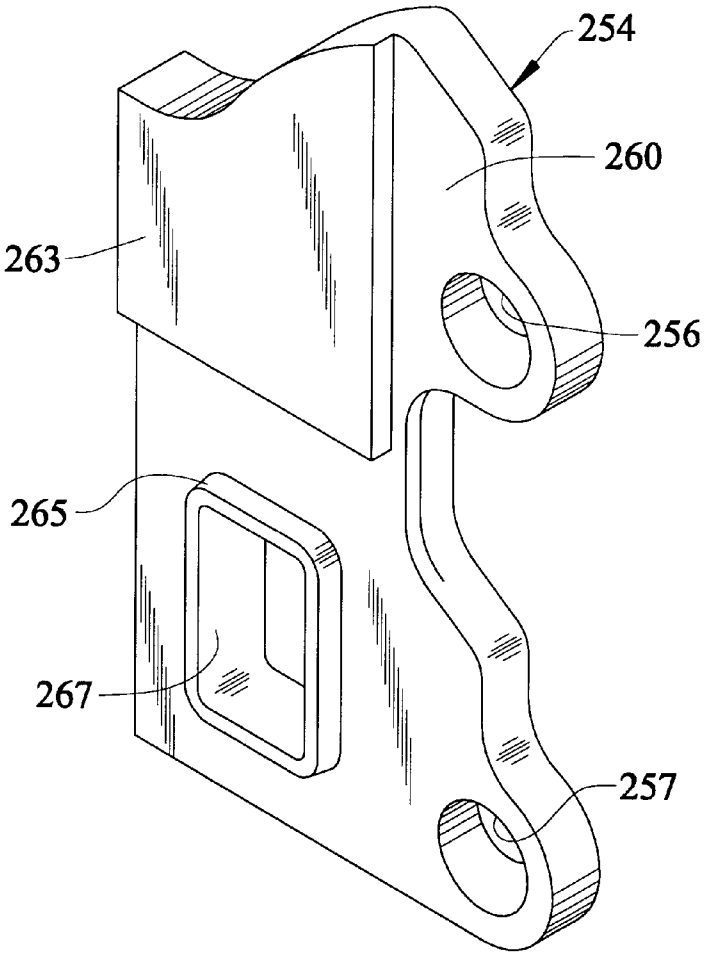
FIG. 9B is an upper left perspective view of the air tunnel insert of FIG. 9A.
Figure 9A:
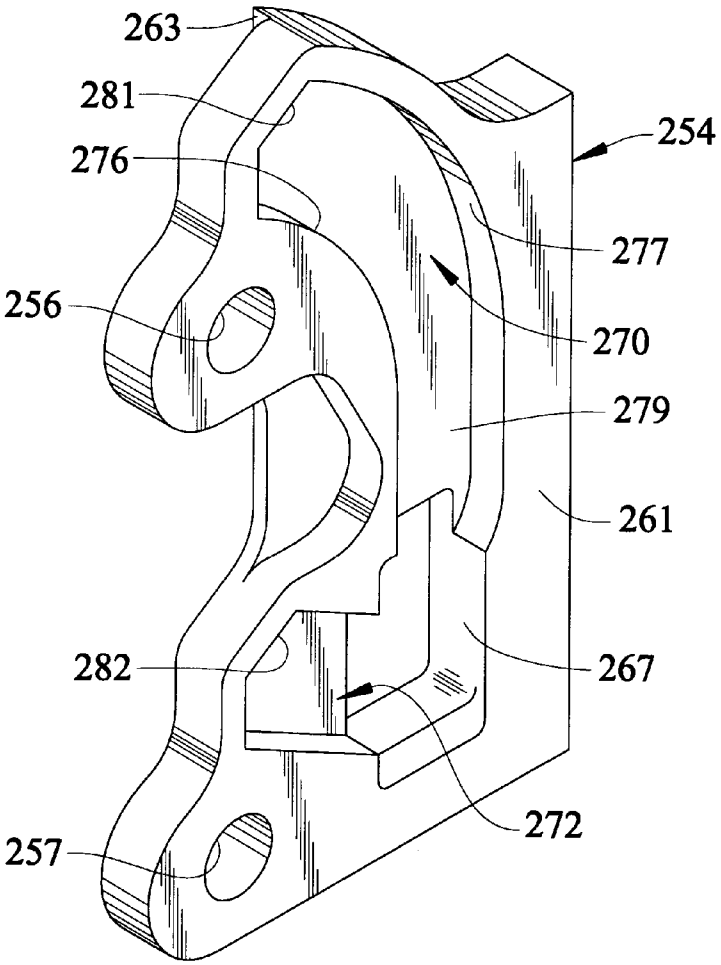
FIG. 9A is an upper right perspective view of an air tunnel insert constructed in accordance with the present invention.

Reference will now be made to FIGS. 9A, 9B, 10A and 10B in describing the particular manner in which cooling air is supplied to and exhausted from the vertically spaced food storage compartment systems 30, 30*a*. Upon the assembly of refrigerator cabinet 2, side wall 204 of fresh food liner 6 and side wall 230 of freezer liner 226 will be spaced by a mullion zone 251 (see FIG. 10B) which is typically filled with an insulating foam during a latter stage of the overall refrigerator assembly process. In accordance with a particular aspect of the present invention, a tunnel insert, generally indicated at 254, is positioned between fresh food liner 6 and freezer liner 226. As best shown in FIGS. 9A and 9B, tunnel insert 254 is formed with an upper passage 256 and a lower passage 257. Both passages 256 and 257 extend entirely through tunnel insert 254 from a freezer side 260 to a fresh food side 261. In the most preferred form of the invention, passages 256 and 257 are generally circular in shape and actually taper from freezer side 260 to fresh food side 261. For instance, a preferred embodiment of the invention has each of passages 256 and 257 taper from approximately a 1⅝ diameter to a 1¼ diameter from freezer side 260 to fresh food side 261. Tunnel insert 254 is also preferably provided with a shoulder extension 263 which projects outwardly further from a plane generally defined by the surface of freezer side 260. Furthermore, freezer side 260 has projecting therefrom an annular collar 265 that defines, at least in part, an enlarged passage 267. On fresh food side 261, tunnel insert 254 is formed with an elongated channel 270 and a shorter channel 272, both of which lead to enlarged passage 267. In general, channels 270 and 272 are created by forming grooves within tunnel insert 254, with each of the grooves being generally defined by spaced walls 276 and 277 and a connecting or base wall 279. Again, each of channels 270 and 272 open at enlarged passage 267 and, at a remote position, include respective end walls 281 and 282.

During assembly of refrigerator cabinet 2, tunnel insert 254 is arranged between fresh food liner 6 and freezer liner 226 as generally shown in FIG. 10A and becomes sandwiched between liners 6 and 226 within mullion zone 251 as shown in FIG. 10B. More specifically, tunnel insert 254 becomes seated against freezer liner 226 with collar 265 projecting into return opening 240 and shoulder extension 263 is received within a recessed area 284 formed as part of freezer liner 226. When properly positioned in this fashion, upper passage 256 of tunnel insert 254 is aligned with both upper inlet opening 218 and upper air supply opening 242. In a similar manner, lower passage 257 is aligned with lower inlet opening 221 and lower air supply opening 243. With this arrangement, air is permitted to flow from freezer compartment 227 into fresh food compartment 8 through both upper and lower passages 256 and 257. With further reference to FIG. 6 above, each passage 256 and 257 is directly aligned with an inlet opening 77*a* of a respective specialty food storage compartment 30*a*. Since two such specialty compartments are preferably provided in accordance with the invention, tunnel insert 254 includes both upper and lower passages 256 and 257. Of course, if only a single specialty compartment 30*a* was provided, only a single passage 256 or 257, along with the corresponding respective channel 270 or 272, would be needed. In any event, tunnel insert 254 provides for the flow of cooling air from freezer compartment 227 to fresh food compartment 8 through the mullion zone 251.

As discussed above with respect to the exemplary embodiment of FIG. 6, food storage compartment 30*a* includes an air outlet 76*a* which is preferably provided with a flap valve 165 that only permits air to exit outer housing 37. In any event, each opening 76*a* of a respective upper and lower food storage system 30*a* is aligned with a respective outlet or exhaust opening 219, 222. Outlet openings 219 and 222 are generally shaped to conform to the portions of channels 270 and 272 near end walls 281 and 282 of insert 254. More specifically, when tunnel insert 254 is positioned within the mullion zone 251, a portion of fresh food liner 6 extends across the grooves formed in tunnel insert 254 and creates a fourth wall that cooperates with walls 276, 277 and 279 to create the overall channels 270 and 272. Therefore, tunnel insert 254 essentially defines three of the four walls for each of channels 270 and 272 and fresh food liner 6 defines the fourth wall. In any event, each exhaust opening 76*a* is aligned with a respective outlet opening 219, 222 and therefore the air exiting opening 76*a* can flow within a respective channel 270, 272 towards the enlarged passage 267 that is aligned with the main air return opening 215 of fresh food liner 6 and the air return opening 240 of freezer liner 226. With this construction, the exhaust air from each of the specialty food compartments 30 or 30*a* is mixed with the main return air from the remainder of fresh food compartment 8 such that these combined air flows can return to an evaporator coil area which is preferably located near a defrost heater for overall refrigerator cabinet 2. Again, the manner in which a main supply of cooling air flows through a refrigerator is not considered part of the present invention. However, the incorporation of tunnel insert 254 and the manner in which the air flow is directed into, around and exhausted from the food storage compartment systems 30, 30*a* is considered particularly advantageous, with the single tunnel insert 254 defining multiple passages between the fresh food and freezer compartments 8 and 227 in an extremely efficient and economical manner.

Figure 2:
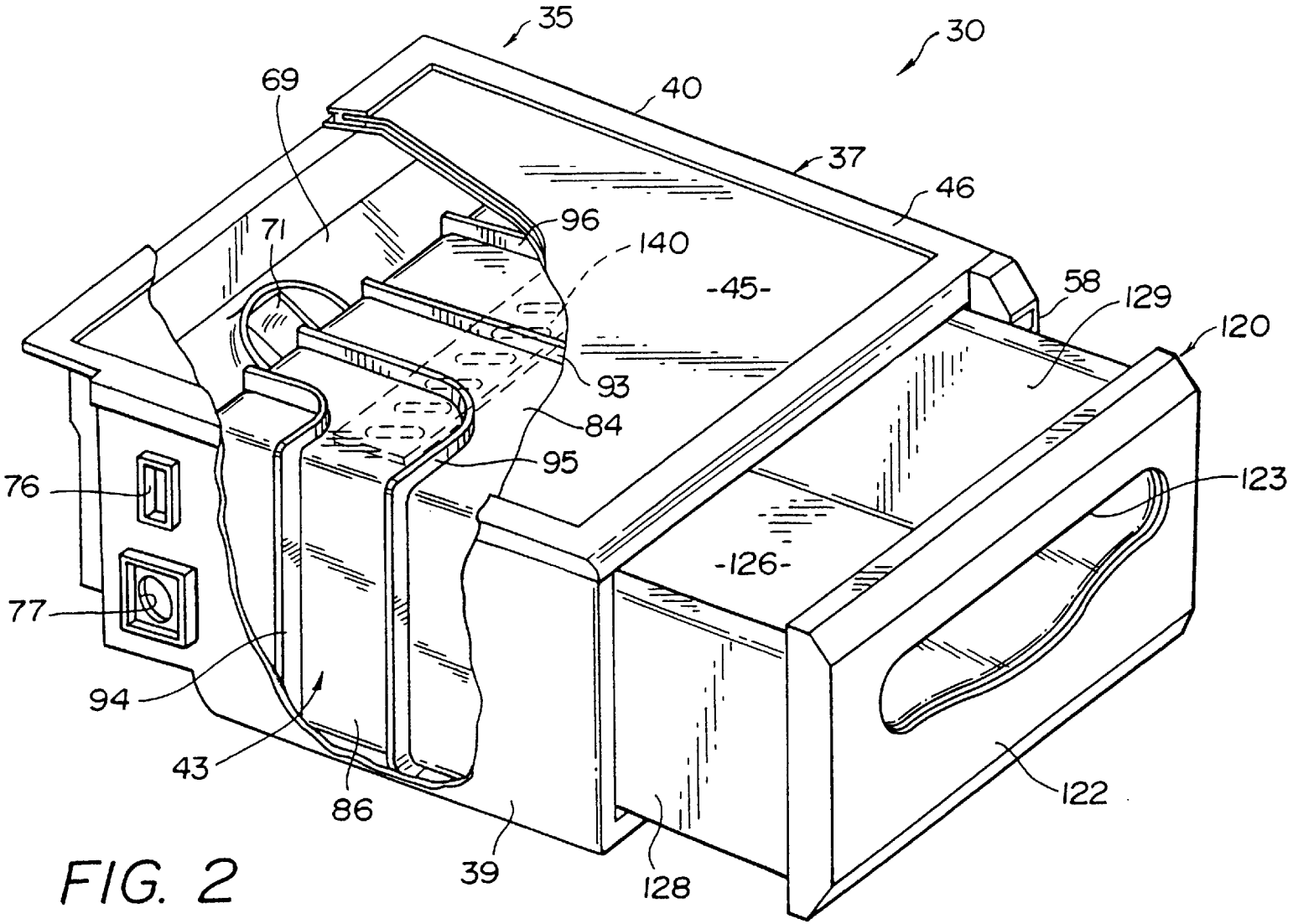
FIG. 2 is an enlarged, partial cut-away view of the system illustrated in FIG. 1.
Figure 11A:
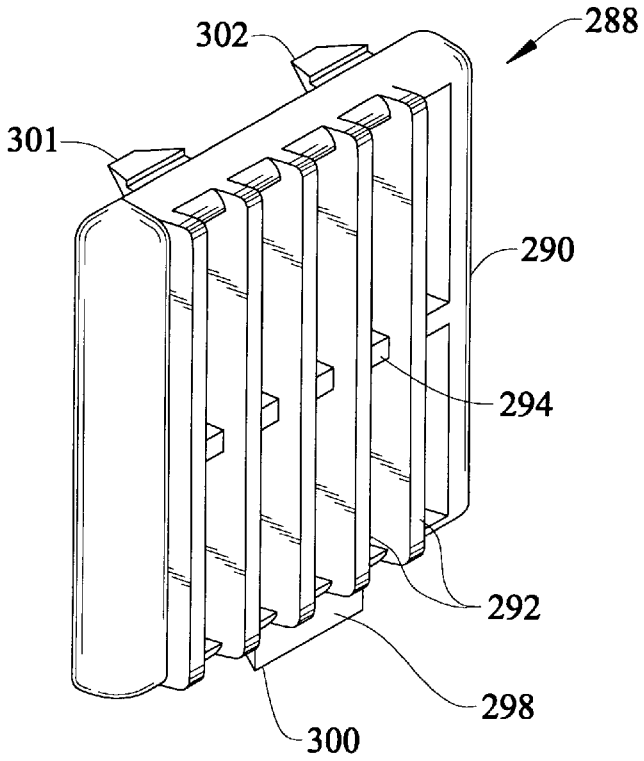
FIG. 11A is an upper left perspective view of an air inlet cover provided in accordance with the present invention.
Figure 11B:
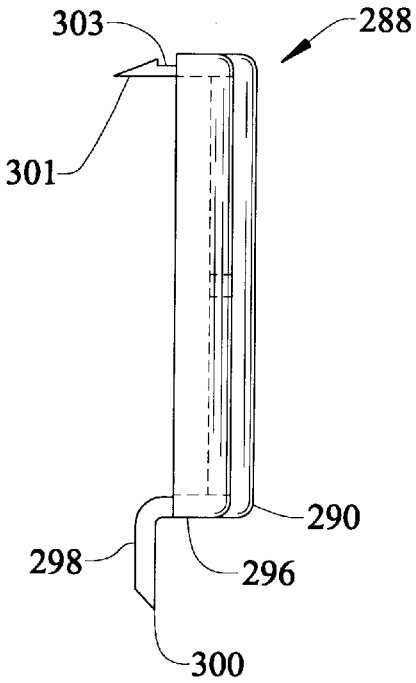
FIG. 11B is a left side view of the air inlet cover of FIG. 11A.

Obviously the individual food storage compartment systems 30, 30*a* extend about and cover the various inlet and outlet openings 218, 219, 221 and 222 formed in side wall 204 of fresh food liner 6 and are also designed to provide ample clearance for the flow of air to main air return opening 215 as perhaps best indicated with the left rear corner configurations shown in FIGS. 2 and 3 of this application. However, in freezer compartment 227, there visually remains upper and lower supply openings 242 and 243. In accordance with the present invention, as shown in FIGS. 11A and 11B, a supply air opening cover 288 is provided. Each supply air opening cover 288 includes a main body 290 formed with a plurality of louvers 292 that are interconnected by central ribs 294. A lower side 296 of main body 290 is formed with an outwardly extending tab 298 that includes a pointed edge 300. Opposite lower side 296, main body 290 is formed with a plurality of spaced locking tabs 301 and 302. As shown, each locking tab 301, 302 is formed with an undercut portion 303. Each supply opening cover 288 is adapted to extend over and cover a respective upper or lower air supply opening 242, 243. Due to the configuration of each of the upper and lower air supply openings 242 and 243, outwardly extending tab 298 is actually initially forced between freezer liner 226 and tunnel insert 254 at the lower, tapered section of a respective air supply opening 242, 243 and then supply air opening cover 288 is pivoted until locking tabs 301, 302 project into tunnel insert 254 and snap against freezer liner 226 with the freezer liner 226 being received in the undercut portion 303. In the most preferred embodiment of the invention, tunnel insert 254 is formed from expanded polystyrene such that the material for tunnel insert 254 can be easily deformed to accommodate tabs 298, 301 and 302. For the sake of completeness, tunnel insert 254 is generally in the order of 15" in height and approximately 9" wide. Channels 270 and 272 are preferably slightly greater than ½ deep and, most preferably, 0.62" deep. For the sake of completeness, enlarged passage 267 is in the order of 2" wide and 3¼ in height. As opposed to tunnel insert 254, each supply air opening cover 288 is quite small, generally in the order of 2" square. In the most preferred form of the invention, louvers 292 extend vertically within freezer compartment 227 and are angled forwardly such that a normal flow of cooling air within freezer compartment 227 at this lower portion of freezer liner 226 will lead into upper and lower air supply openings 242 and 243.

Although described with respect to the preferred embodiment of the invention, it should be readily apparent that various changes and/or modifications can be made to the air flow arrangement for the storage compartment system of the present invention without departing from the spirit thereof. Again, the invention is particularly directed to the manner in which air is delivered to and exhausted from each of the storage compartment systems 30, 30*a*, as well as the manner in which the exhausted air combines with the return air for the overall fresh food compartment. Controlling the rates at which the air flows into and out of the various food storage compartments, as well as the fresh food compartment in general, is covered by an application entitled "Refrigerator Food Storage Temperature Control System" filed on even date herewith, and incorporated herein by reference. In any event, the invention is only intended to be limited by the scope of the following claims.

We claim:

1. A side-by-side refrigerator comprising:

first and second liners defining fresh food and freezer compartments respectively, said first and second liners being separated by a dividing mullion zone;

a food storage system including at least one food receptacle slidably mounted within the fresh food compartment for movement between extended and retracted positions, said food storage system having an associated cooling air inlet and an associated cooling air outlet;

a first passage fluidly interconnecting the freezer compartment with the fresh food compartment for introducing a flow of cooling air from the freezer compartment into the fresh food compartment;

a second passage fluidly interconnecting the freezer compartment with the food storage system for providing a flow of cooling air for the food storage system; and a third passage fluidly interconnecting the fresh food compartment with the freezer compartment for permitting a flow of return air from the fresh food compartment to the freezer compartment, each of said second and third passages being defined, at least in part, by a tunnel insert positioned in the mullion zone, said tunnel insert including a first through hole in fluid communication with the cooling air inlet of the food storage system and an enlarged opening forming part of the third passage.

2. The side-by-side refrigerator according to claim 1, wherein the tunnel insert further includes a channel having a portion aligned with the cooling air outlet of the food storage system.

3. The side-by-side refrigerator according to claim 2, wherein the channel leads, within the mullion zone, to the third passage.

4. The side-by-side refrigerator according to claim 3, wherein the third passage leads to an opening formed in the second liner, said tunnel insert including a collar about the enlarged opening which engages the second liner.

5. The side-by-side refrigerator according to claim 3, wherein the channel has four walls, with three of the four walls being defined by portions of the tunnel insert and a fourth of the four walls being defined by one of the fresh food and freezer liners.

6. The side-by-side refrigerator according to claim 5, wherein the fourth wall is defined by a portion of the fresh food liner.

7. The side-by-side refrigerator according to claim 2, wherein the food storage system includes first and second food receptacles which are vertically spaced within the fresh food compartment, the first and second food receptacles including respective air inlets and outlets, said tunnel insert including a second through hole fluidly interconnecting the inlet of the second food receptacle with the freezer compartment.

8. The side-by-side refrigerator according to claim 7, wherein the tunnel insert defines a second channel leading, within the mullion zone, to the third passage, said second channel being in fluid communication with the air outlet for the second food receptacle.

9. The side-by-side refrigerator according to claim 1, further comprising: an inlet cover mounted in the freezer compartment and extending over the second passage.

10. The side-by-side refrigerator according to claim 9, wherein the inlet cover includes a plurality of louvers which are angled forwardly within the freezer compartment.

11. The side-by-side refrigerator according to claim 1, wherein the food storage system includes a flap valve member adapted to control a flow of air through the cooling air outlet.

12. A side-by-side refrigerator comprising:

first and second liners defining fresh food and freezer compartments respectively, said first and second liners being separated by a dividing mullion zone;

a food storage system including at least one food receptacle slidably mounted within the fresh food compartment for movement between extended and retracted positions, said food storage system having an associated cooling air inlet and an associated cooling air outlet;

a first passage fluidly interconnecting the freezer compartment with the fresh food compartment for introducing a flow of cooling air from the freezer compartment into the fresh food compartment;

a second passage fluidly interconnecting the freezer compartment with the food storage system for providing a flow of cooling air for the food storage system, said second passage being defined, at least in part, by a tunnel insert positioned in the mullion zone; and a third passage fluidly interconnecting the fresh food compartment with the freezer compartment, wherein said tunnel insert includes a channel for fluidly interconnecting the cooling air outlet of the food storage system and the third passage.

13. The side-by-side refrigerator according to claim 12, wherein the tunnel insert is formed within an enlarged opening which defines, at least in part, the third passage.

14. The side-by-side refrigerator according to claim 13, wherein the third passage leads to an opening formed in the second liner, said tunnel insert including a collar about the third passage which engages the second liner.

15. The side-by-side refrigerator according to claim 13, wherein the channel has four walls, with three of the four walls being defined by portions of the tunnel insert and a fourth of the four walls being defined by one of the fresh food and freezer liners.

16. The side-by-side refrigerator according to claim 15, wherein the fourth wall is defined by a portion of the fresh food liner.

17. The side-by-side refrigerator according to claim 12, wherein the food storage system includes first and second food receptacles which are vertically spaced within the fresh food compartment, the first and second food receptacles including respective air inlets and outlets, said tunnel insert including a second through hole fluidly interconnecting the inlet of the second food receptacle with the freezer compartment.

18. The side-by-side refrigerator according to claim 17, wherein the tunnel insert defines a second channel leading, within the mullion zone, to the third passage, said second channel being in fluid communication with the air outlet for the second food receptacle.

19. The side-by-side refrigerator according to claim 12, further comprising, an inlet cover mounted in the freezer compartment and extending over the second passage.

20. The side-by-side refrigerator according to claim 19, wherein the inlet cover includes a plurality of louvers which are angled forwardly within the freezer compartment.

21. The side-by-side refrigerator according to claim 12, wherein the food storage system includes a flap valve member adapted to control a flow of air through the cooling air outlet.

22. In a refrigerator including side-by-side freezer and fresh food compartments separated by a mullion zone, and at least one food storage system mounted in the fresh food compartment, a method of directing air flow to and from the fresh food compartment comprising:

directing a main, first flow of cooling air into the fresh food compartment from the freezer compartment at a first location;

directing a flow of return air out of the fresh food compartment at a second location;

directing a second flow of cooling air from the freezer compartment to the food storage system at a third location; and channeling, within the mullion zone, a flow of exhaust air from the food storage system towards the second location to mix with the flow of return air exiting the fresh food compartment.

23. The method according to claim 22, further comprising:

providing passages between the freezer and fresh food compartments at each of the first, second and third locations; and locating an insert in the mullion zone to create a channel for the flow of exhaust air, and the passages at the second and third locations.

24. The method according to claim 23, further comprising: creating the channel with four walls, with three of the four walls being formed by the insert and a fourth of the four walls being formed by a portion of a liner defining the fresh food compartment.

* * * * *